US005836038A

United States Patent [19]

Thorp

[11] Patent Number: 5,836,038

[45] Date of Patent: Nov. 17, 1998

[54] MAGNETIC MOUNT DRY ERASER

[76] Inventor: Kelly R. Thorp, 1708 Cougar Ave., Norfolk, Va. 23518

[21] Appl. No.: 953,405

[22] Filed: Oct. 17, 1997

Related U.S. Application Data

[60] Provisional application No. 60/030,616, Nov. 7, 1996.

[51] Int. Cl.[6] ..... A47L 13/16; A47G 29/00

[52] U.S. Cl. ..... 15/209.1; 248/206.5; 248/683

[58] Field of Search ..... 15/209.1, 210.1, 15/220.2, 223, 224, 424–426; 7/901; 209/215; 248/206.5, 309.4, 683; 294/65.5

[56] References Cited

U.S. PATENT DOCUMENTS

| | | | |
|---|---|---|---|
| D. 162,583 | 3/1951 | Schmitman et al. | D7/641 |
| 466,337 | 1/1892 | Pries | 15/231 |
| 1,624,741 | 4/1927 | Leppke et al. | 40/621 |
| 1,932,143 | 10/1933 | Piercy | 362/398 |
| 2,414,872 | 1/1947 | Hartner | 15/231 |
| 2,434,973 | 1/1948 | Williams | 15/426 |
| 2,520,085 | 8/1950 | Griffin et al. | 15/426 |
| 2,825,177 | 3/1958 | Nordlof et al. | 248/309.4 |
| 3,039,435 | 6/1962 | Meyer | 15/424 X |
| 3,110,917 | 11/1963 | McPeek, Jr. | 248/683 X |
| 3,842,980 | 10/1974 | Kushner | 248/205.3 |
| 4,554,703 | 11/1985 | Matuki | 15/424 |
| 4,660,715 | 4/1987 | Anastos | 206/8 |
| 4,697,301 | 10/1987 | Palmans | 15/223 X |
| 4,937,910 | 7/1990 | Frazier | 15/213 |

FOREIGN PATENT DOCUMENTS

| | | | |
|---|---|---|---|
| 3211859 | 10/1983 | Germany . | |
| 63-57299 | 3/1988 | Japan . | |
| 3900462 | 7/1988 | Japan . | |
| 6-183196 | 7/1994 | Japan . | |
| 253436 | 11/1948 | Switzerland . | |
| 880914 | 10/1961 | United Kingdom | 248/309.4 |
| 93/15919 | 8/1993 | WIPO | 15/424 |

*Primary Examiner*—Mark Spisich
*Attorney, Agent, or Firm*—Richard C. Litman

[57] ABSTRACT

An eraser is disclosed for use in conjunction with dry erase boards. The eraser includes a rigid support member having a layer of non-abrasive material attached to the bottom surface thereof and a strip of magnetic material attached to the top surface thereof. The non-abrasive material is used to remove the ink from the dry erase board, while the magnetic material allows the eraser to be conveniently positioned in relation to the dry erase board. The eraser is designed for use with any dry erase board.

7 Claims, 2 Drawing Sheets

MAGNETIC MOUNT DRY ERASER

CROSS-REFERENCE TO RELATED APPLICATION

This application claims the benefit of U.S. Provisional Patent Application Ser. No. 60/030,616, filed Nov. 7, 1996.

BACKGROUND OF THE INVENTION

1. Field of the Invention

The present invention relates to erasers and more particularly to erasers designed to remove ink from dry erase boards. The invention is specifically related to an eraser for dry erase boards which may be conveniently mounted in the proximity of any dry erase board.

2. Description of Related Art

Dry erase boards are well known for providing a convenient and efficient method of temporarily writing information. Dry erase boards are commonly found in popular locations such as refrigerator doors, offices, hallways, and reception areas. A dry erase board is written upon with a felt-tipped pen which dispenses an ink that dries on the board. The ink used in the pen is a non-permanent type, such that the writing may subsequently be erased. During the erasure process, the ink becomes a loose dust which is subsequently removed from the board by the eraser.

The use of dry erase boards has increased such that it has become common to find various sizes of dry erase boards which are suited for use in specific locations. While dry erase boards are manufactured in various sizes and by various companies, one factor remains common to most commercial dry erase board. This factor is the lack of an eraser suited for use with the dry erase boards. Furthermore, no storage area is provided for receiving an eraser. Consequently, users employ paper towels or napkins to clean the dry erase board. However, these products are abrasive and will ruin the dry erase board with extended use. Thus, it remains difficult for users of dry erase boards to perform erasure functions using a proper eraser which is conveniently located with respect to the dry erase board.

The prior discloses several types of erasers and holders therefor. For example, U.S. Pat. No. 2,434,973 issued on Jan. 27, 1948 to Williams discloses an eraser with magnetic supporting means. The eraser is specifically suited for making erasures upon papers in a typewriter. The eraser has a circular shape and is mounted about a metal sleeve having magnetic properties.

U.S. Pat. No. 2,520,085 issued on Aug. 22, 1950 to Griffin et al. discloses an eraser and holder. The eraser is contained in the holder which includes magnetic metal. The holder may incorporate a brush to remove eraser and paper dust after erasures have been made.

U.S. Pat. No. 3,842,980 issued on Oct. 22, 1974 to Kushnrer discloses a magnetic supporting means. The device includes a holder composed of magnetically conductive material having bottom and side portions. The device receives a magnetic source member within the holder and proximate its bottom and side portions. The bottom portion of the holder includes means, secured thereto, for attaching the holder to a supporting surface. The holder is composed of metallic material and the member is composed of a flexible plastic material with permanently magnetized ferrite particles embedded therein.

U.S. Pat. No. 4,554,703 issued on Nov. 26, 1985 to Matuki discloses a magnetic eraser dust collector. The device is suited for use with an eraser of rubber composition which includes magnetic particles dispersed therein. The device has a permanent magnet for attracting the magnetic dust created by use of the eraser. The device further includes a shield normally enclosing the magnet for removal of the collected dust. When the shield is held close to or in direct contact to the eraser dust, the magnet attracts the dust to the shield. The dust may be easily disposed by removing the magnet from the shield.

U.S. Pat. No. 4,937,910 issued on Jul. 3, 1990 to Frazier discloses a white board eraser. The eraser is suited for removal of dry ink dust and for conditioning of white boards. The eraser includes a stack of fabric layers of semi rectangular shape which are fastened to a jacket cover which is folded over a central core. The fabric layers have tab dispensing ends and other tab ends and other tabs fastened to the cover. The layers may be removed one at a time and may be treated with cleaning and anti-static compounds.

None of the above inventions and patents, taken either singularly or in combination, is seen to describe the instant invention as claimed. Thus a magnetic mount dry eraser solving the aforementioned problems is desired.

SUMMARY OF THE INVENTION

Accordingly, it is a principal object of the invention to provide an eraser for a dry erase board which may be conveniently stored.

It is another object of the invention to provide an eraser which may be easily stationed proximate the dry erase board.

It is an object of the invention to provide improved elements and arrangements thereof in an eraser for the purposes described which is inexpensive, dependable and fully effective in accomplishing its intended purposes.

In accordance with the objects of the invention, an eraser is provided for use with dry erase boards. The eraser includes a rigid support member which has a top surface and a bottom surface. A layer of non-abrasive material is attached to the bottom surface of the support member in order to remove ink which is present on the dry erase board. A strip of magnetic material is disposed on the top surface of the of the support member. The magnetic material allows the eraser to be conveniently positioned in relation to the dry erase board.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
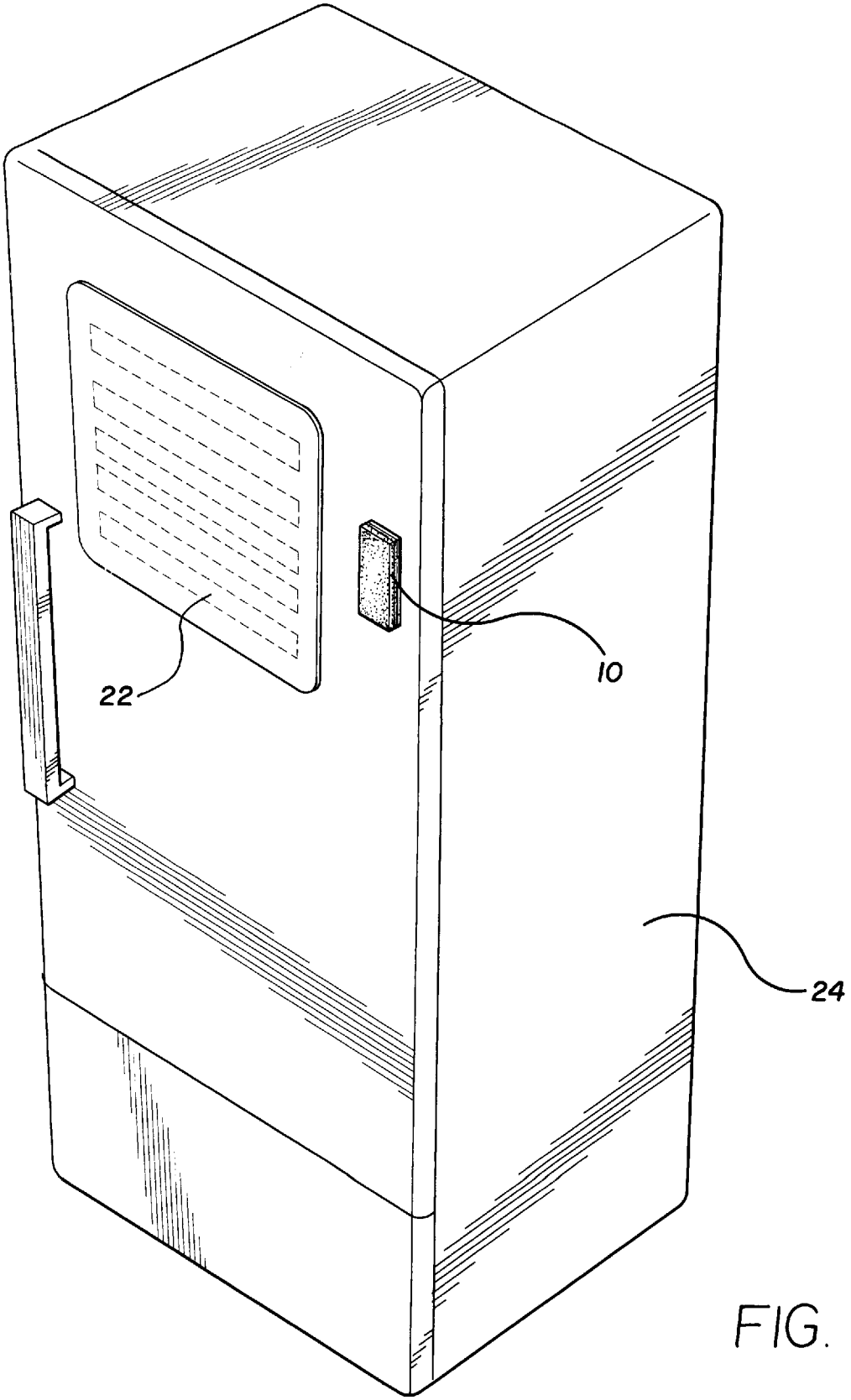
FIG. 1 is an environmental, perspective view of an eraser according to the present invention.

With reference to the drawings and initially to FIG. 1, an eraser 10 is shown mounted on the door of a refrigerator 24 at a location proximate a dry erase board 22. The dry erase board 22 may be secured to the refrigerator 24 in many ways including magnetically. While the eraser 10 is illustrated in connection with a dry erase board 22 it may be used on a variety of surfaces including overhead transparencies. The eraser 10 is designed in such a manner as to reduce it's size and weight, thereby allowing aesthetic storage with respect to the operating area.

Figure 2:
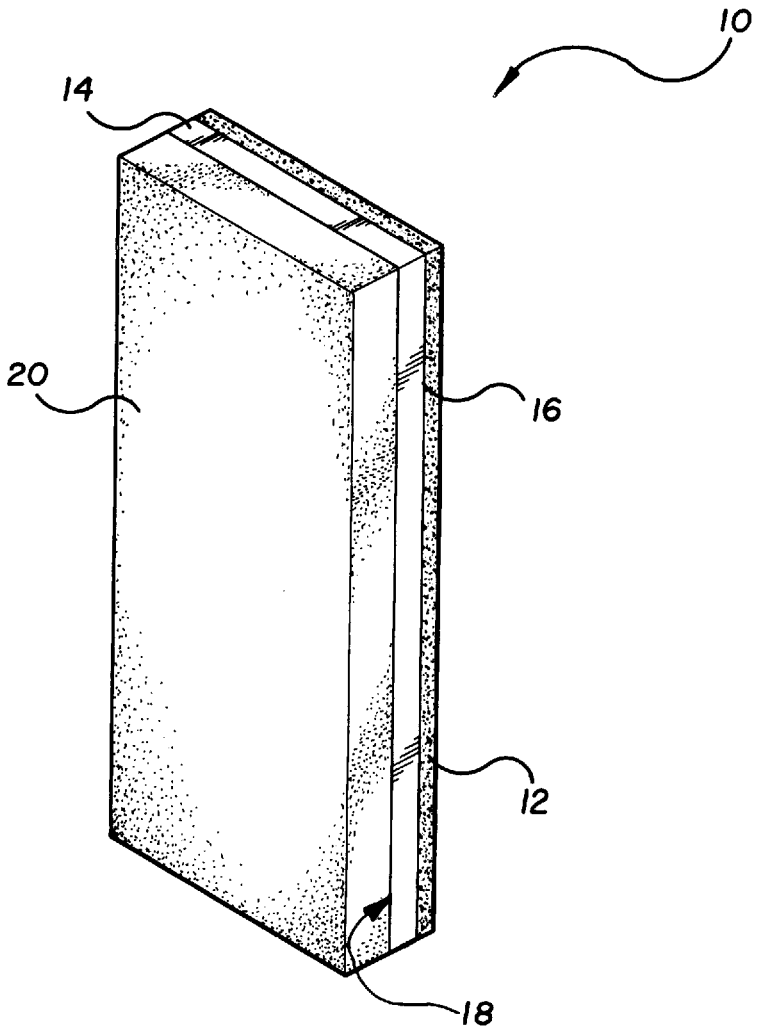
FIG. 2 is a perspective view of the eraser of the present invention.

Turning to FIG. 2, the eraser 10 is seen to include a rigid support member 14 having a top surface 16 and a bottom surface 18. The support member 14 may be constructed of a variety of materials, such as plastic or wood, capable of reducing the weight while providing sufficient structural rigidity. A layer of non-abrasive material 20 is attached to the bottom surface 18 of the support member 14. The layer of non-abrasive material 20 is used to remove ink which remains on the dry erase board 22 after it has been written on. The layer of non-abrasive material 20 may be composed of a felt material which may be synthetic or wool. A strip of magnetic material 12 is disposed on the top surface 16 of the of the support member 14. The magnetic material 12 allows the eraser 10 to be conveniently positioned in relation to the dry erase board 22 so long as the surface where the eraser 10 is placed has corresponding magnetic properties.

It is to be understood that the present invention is not limited to the embodiment described above, but encompasses any and all embodiments within the scope of the following claims.

I claim:

1. An eraser comprising:

a substantially thin rigid support member including top and bottom planar surfaces;

a magnetic attraction means disposed on the top surface of said support member for securing said eraser to a metallic surface, said magnetic attraction means being coextensive with said top surface; and erasure means disposed on the bottom surface of said support member for removing markings of a predetermined origin, said erasure means being coextensive with said bottom surface.

2. An eraser as recited in claim 1 wherein said rigid support member is constructed of foam.

3. An eraser as recited in claim 1 wherein said rigid support member is constructed of plastic.

4. An eraser as recited in claim 3 wherein said erasure means comprises a layer of absorbent felt material.

5. An eraser as recited in claim 1 wherein said rigid support member is constructed of wood.

6. An eraser as recited in claim 1 wherein said rigid support member is constructed of hardened felt.

7. An eraser as recited in claim 1 wherein said magnetic attraction means comprises a magnetic strip.

* * * * *